US005924554A

United States Patent [19]

Dosmo et al.

[11] Patent Number: 5,924,554

[45] Date of Patent: Jul. 20, 1999

[54] CURRENT SWITCH WITH MOVING CONTACTS

[75] Inventors: Renato Dosmo, Brembate Di Sopra; Maurizio Curnis, Calusco D'Adda, both of Italy

[73] Assignee: ABB Sace S.p.A., Bergamo, Italy

[21] Appl. No.: 08/993,041

[22] Filed: Dec. 18, 1997

[30] Foreign Application Priority Data

Dec. 20, 1996 [IT] Italy ..... MI96A2687

[51] Int. Cl.[6] ..... H01H 3/46; H01H 77/10

[52] U.S. Cl. ..... 200/400; 218/154; 335/191

[58] Field of Search ..... 200/17 R, 18, 200/400, 401, 337; 218/1, 7, 16–22, 30–32, 146, 154; 335/196, 200, 203, 191

[56] References Cited

U.S. PATENT DOCUMENTS

| | | | |
|---|---|---|---|
| 3,005,066 | 10/1961 | Powell | 200/78 |
| 3,832,504 | 8/1974 | Cellerini et al. | 200/153 SC |
| 4,165,453 | 8/1979 | Hennemann | 200/153 G |
| 4,645,891 | 2/1987 | Changle . | |
| 4,845,459 | 7/1989 | Manthe et al. | 335/195 |
| 5,534,674 | 7/1996 | Steffens | 218/154 |

FOREIGN PATENT DOCUMENTS

| | | |
|---|---|---|
| 8428351 | 5/1985 | Germany . |
| 1564412 | 4/1980 | United Kingdom . |

*Primary Examiner*—Michael A. Friedhofer
*Attorney, Agent, or Firm*—Guido Modiano; Albert Josif

[57] ABSTRACT

Current switch with moving contacts cooperating with fixed contacts comprising, for each electric phase, a crank, pivoting about a pin, and a link rod, operationally connected to the crank and to the mechanism for opening and closing the switch, there being provision for the contact-carrying levers to be fulcrumed in the lower part to a pin integral with the crank, for, above the pin, the levers to have, on the opposite side to the contacts, seats against which spring means bear, for the opposite ends of the spring means to bear against seats formed at the top on the side of the support of the crank, opposite the fixed contacts.

12 Claims, 4 Drawing Sheets

CURRENT SWITCH WITH MOVING CONTACTS

BACKGROUND OF THE INVENTION

The invention relates to a current switch with moving contacts comprising, for each electric phase, a crank, pivoting about a pin, and a link rod, operationally connected to the crank and to the mechanism for opening and closing the switch.

It is known that, in particular in low-voltage installations, the use of current switches is widespread. These switches make it possible to minimize the thermal and dynamic stresses present on the electrical components present in the installation downstream of the current switch, in the event of a short-circuit fault occurring or in any case in the event that extremely short times are required for the interruption of currents greater than the rated current.

The use of these known current switches is widespread in installations such as for example large industrial installations, naval installations and petrochemical installations.

In the event that the current switch is required to support a high rated current it will be necessary to use current switches of open type.

In these switches, the autorepulsion effect, caused by the short-circuit current on the contacts of the switch, is exploited in order to obtain rapid opening of the electric circuit. The opening of the contacts through autorepulsion advances the operating of the overcurrent relay. This relay controls the opening of the switch via a mechanical control means with long operating times which are in any event independent of the value of the short-circuit current which it is desired to interrupt.

For the purpose of emphasizing the advantageous effect of autorepulsion of the moving and fixed contacts, the known contact-carrying levers of the current switches are designed with known geometries which accentuate the electrodynamic repulsion which is set up between two conductors traversed by oppositely directed electric current. In this way extremely short times for the opening of the contacts are obtained with a consequent rapid lengthening of the electric arc which forms between the arcing tips of the fixed contacts and of the moving contacts during opening, and a large reduction in the current is obtained.

At present, the mechanism which enables the moving contacts to be separated from the fixed contacts through the effect of electrodynamic repulsion is executed by means of a series of link rods and toggles. These mechanisms are especially complex since they must reside inside the contact-carrying crank and fulfil various functions simultaneously.

In particular, they must exert a strong pressure on the contacts during the working of the switch, they must allow the pivoting of the contact-carrying levers during the repulsion generated by the electrodynamic action and keep the moving contacts separated from the fixed contacts for as long as the control, activated by a relay, does not open the switch.

The large number of components and the presence of a large number of joints renders the operation of the known mechanism highly sensitive to the value of the constructional tolerances and to the correct mounting of the components. Present-day devices are therefore of modest efficiency.

SUMMARY OF THE INVENTION

The objective of the present invention is to overcome the above-indicated drawbacks of the prior art, and in particular to simplify the mechanisms acting on the moving contacts obtaining, at the same time, faster action of opening of the moving contacts and more efficient action of interruption of the current.

A further objective of the invention consists in reducing the times for production and assembly of the switch.

The objectives of the invention are achieved by means of a current switch with moving contacts cooperating with fixed contacts comprising, for each electric phase, a crank, pivoting about a pin, and a link rod, operationally connected to the crank and to the mechanism for opening and closing the switch, characterized in that contact-carrying levers are fulcrumed in the lower part to a pin integral with the crank, in that, above the pivot pin the levers have, on the opposite side to the contacts, seats against which spring means bear, in that the opposite ends of the spring means bear against seats formed at the top on one side of the support of the crank, opposite the fixed contacts.

Since the springs always exert a thrust action on the contact-carrying levers, in order to prevent, during the pivoting of the contact-carrying levers, the springs from flexing, impairing correct operation, the springs are guided by staffs which extend from the seat of the support to the seat of the levers.

Advantageously, the staffs have rectangular cross-sections.

With further advantage the seat of the support has the shape of a ring received by a pin connected to the support of the crank.

It is an advantage that the annular seat has a bearing surface for the spring means.

So that on the contact-carrying levers the action of the springs should keep the levers open, when the levers are arranged in the retracted or open position, and in order to have a relatively compact arrangement of the components, depressions forming seats for the bodies of the spring means are provided on the contact-carrying levers, on the side facing the spring.

For the purpose of having an arresting area for the contact-carrying levers arranged in the retracted position, circular seats for receiving the annular shapes of the seats of the support are provided on the contact-carrying levers.

In order to link the springs with the contact-carrying levers and to allow the sliding of the springs on the guide staffs, the springs bear against the contact-carrying levers with the interposition of caps having through-openings which receive the guide staffs in a slideable manner and have lateral pins couplable with the seats of the contact-carrying levers.

For the purpose of precluding during the pivoting of the contact-carrying levers the guide staffs from coming into contact with the contact-carrying levers, the seats for the pins of the caps have grooves.

Advantageously, the height of the grooves is greater than the maximum insertion of the staff into the cap.

Advantageously the grooves are made with shoulders having on the top the seats for the pins of the caps.

To prevent the mechanism from opening, during mounting or dismantling, disassembling the various components, a stop pin effecting a limitation in the pivoting of the moving contact-carrying levers is present on the support crank of the contact-carrying levers.

The advantages of the present invention are to be perceived mainly in the greater executional simplicity of the mechanism for controlling the moving contacts.

Executional simplicity which resides essentially in the fact of using the lever of the moving contacts as the staff of a three-hinge mechanism. This execution leads to a considerable advantage in the operation of the device. Thus, the electrodynamic force of repulsion of the moving contacts is exploited in order to compress, with the contact-carrying lever, the spring directly and to pass from a position of the contact-carrying lever extended and stable (working position) to a position of the contact-carrying lever fully retracted and also stable, via a series of positions of the contact-carrying lever which are unstable and hence cannot be maintained over time.

A further advantage consists in the simplification of the procedures for mounting the device by virtue of a small number of components and extreme simplicity of connection of the components.

The device thus executed, by virtue of the small number of components and its simplicity of execution is very robust and reliable.

BRIEF DESCRIPTION OF THE DRAWINGS

The subject, devised according to the present invention, will be described below in greater detail and illustrated in an embodiment given merely by way of example, in the appended drawings in which.

Figure 1:
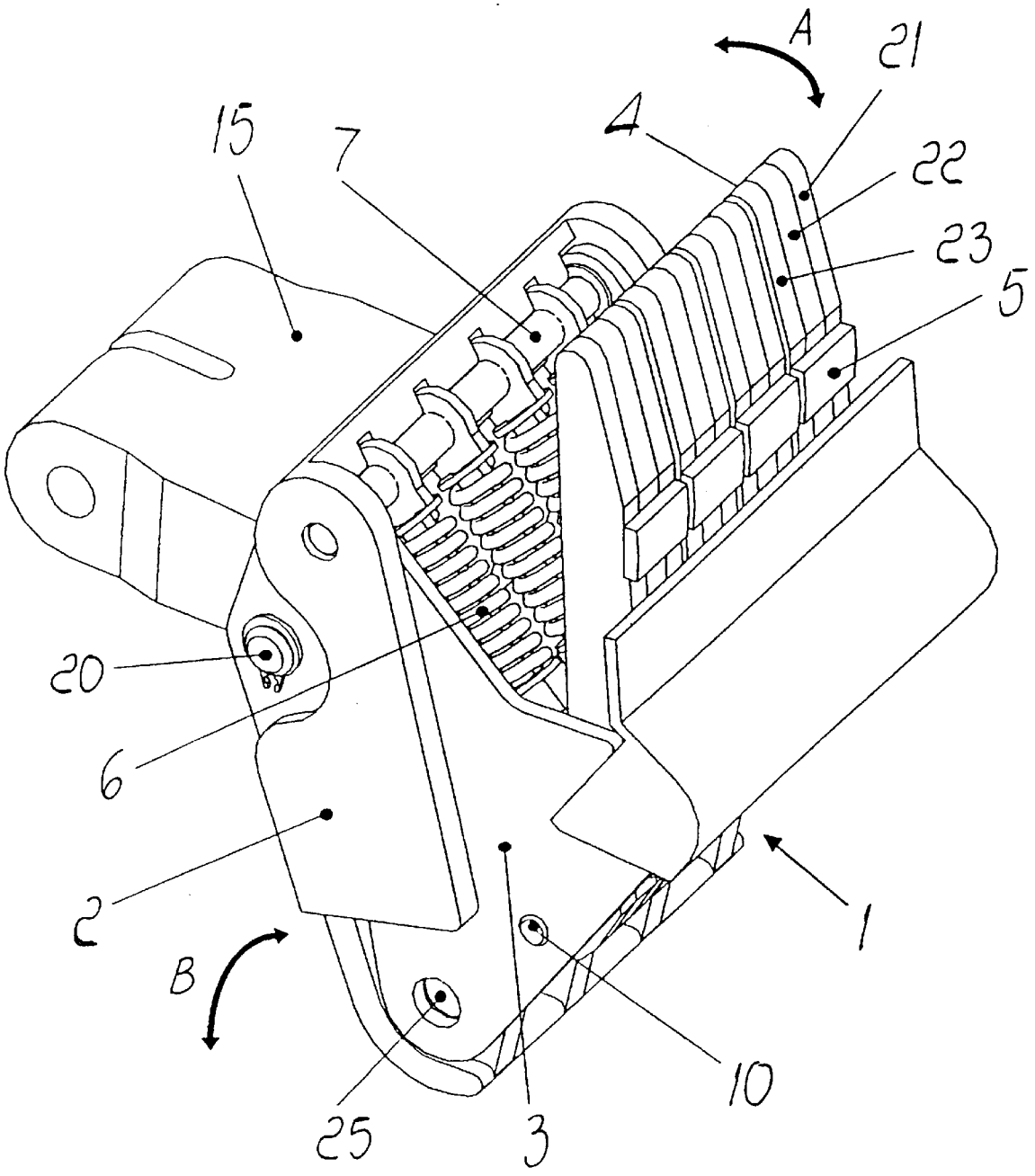
FIG. 1 illustrates, in axonometric view, the moving contacts support crank connected to the insulating link rod.

The current switch is of known construction and operation, so that only those parts which are novel and essential to the invention will be described below.

DESCRIPTION OF THE PREFERRED EMBODIMENTS

From the figures it is possible to observe what are the main components of an electric phase of a low-voltage current switch.

In the electric phase represented there is a crank for supporting the moving contacts, labelled 1 as a whole. The crank 1 consists of a support 2, of insulating material, which via two shoulders 3 supports moving contact-carrying levers 4.

In FIG. 1 the crank 1 is illustrated in the closed position with the contact-carrying levers fully extended.

In the execution illustrated, four levers 4 are represented. Each lever 4 is composed of three staffs 21, 22, 23 or fingers, rigidly connected together and having on the outside a contact pad or arcing tip 5.

Springs 6 bear on the levers 4 of the moving contacts. At the opposite end springs 6 are connected, by means of a pin 7, to the support 2 of the crank 1.

Figure 2:
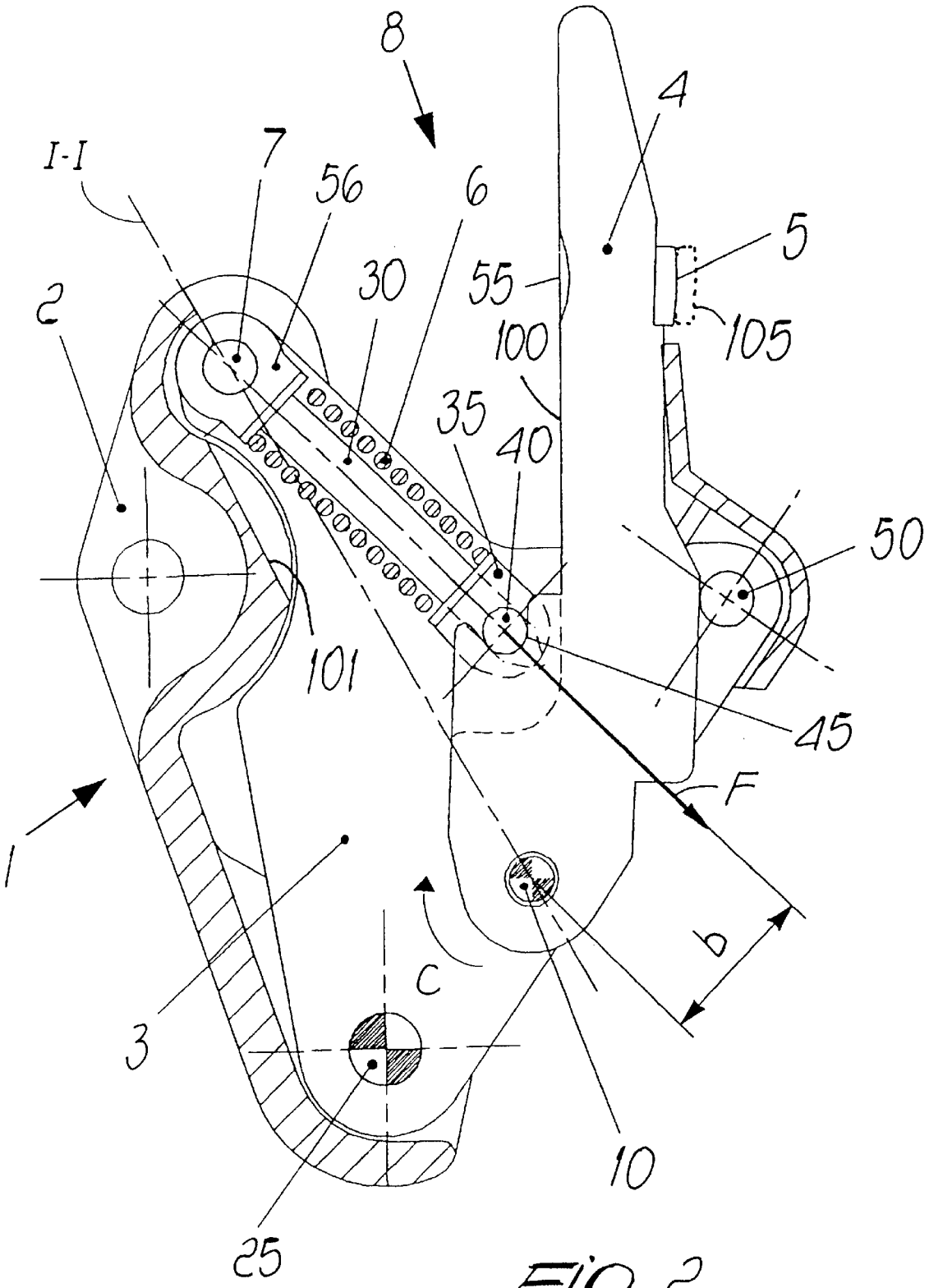
FIG. 2 shows, in partially sectioned side view, the crank for supporting the moving contacts in the closed position with the moving contacts extended.

From FIG. 2 it is possible to observe, with greater detail, the manner in which the spring 6 and the lever 4 of the contacts are connected to the crank 1.

The spring 6 surrounds a guide staff 30. The staff 30 is connected, by an annular head 56 into which the pin 7 is threaded, to the support 2 of the crank 1. The guide staff 30 of the spring 6 is inserted, at the opposite end, into a stop cap 35 for the spring 6 having transverse pins 40.

The cap is inserted into a suitable seat 45 made on the lever 4 of the moving contacts.

The spring 6 and the lever 4 of the moving contacts form a mechanism with three hinges 7, 40, 10 which is supported by the crank 3. The mechanism is indicated 8 as a whole.

Figure 4:
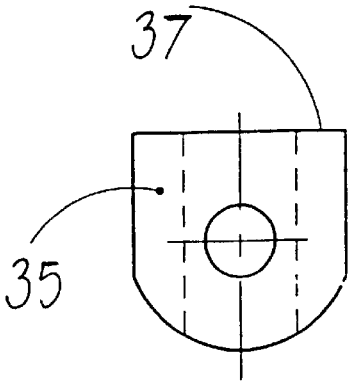
FIGS. 4 and 5 show, in a front and side view, the cap for connecting the spring to the lever of the moving contacts.
Figure 5:
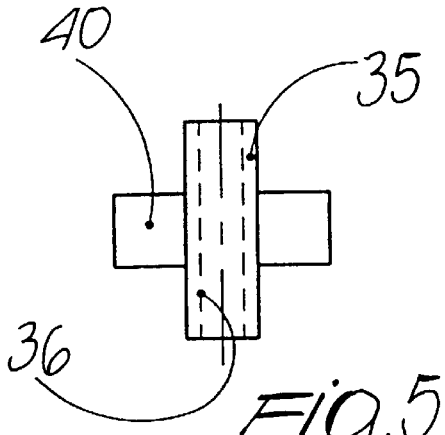

From FIGS. 4 and 5 it is possible to observe the constituent details of the cap of the spring 6.

The cap 35 has a central through-hole 36 which allows the guide staff 30 of the spring 6 to pass. The upper surface 37 of the cap 35 bears on the end turns of the spring 6 and makes it possible to transfer the thrust action of the spring 6 through the lateral pins 45 to the lever 4 of the moving contacts.

Figure 6:
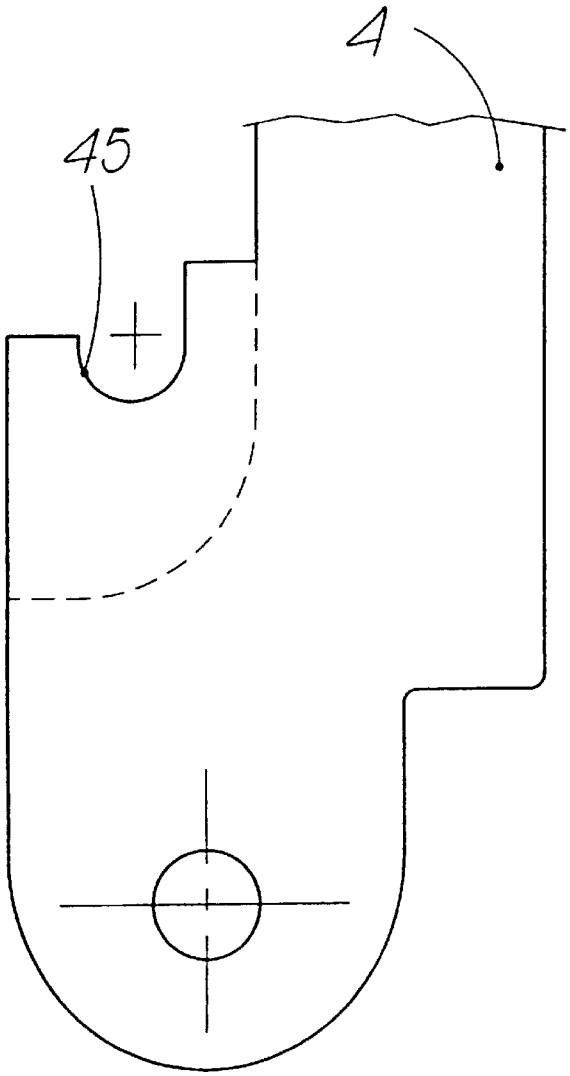
FIGS. 6 and 7 illustrate, in a side and front view, a detail of the lever of the moving contacts referring to the seat for the cap of the spring.
Figure 7:
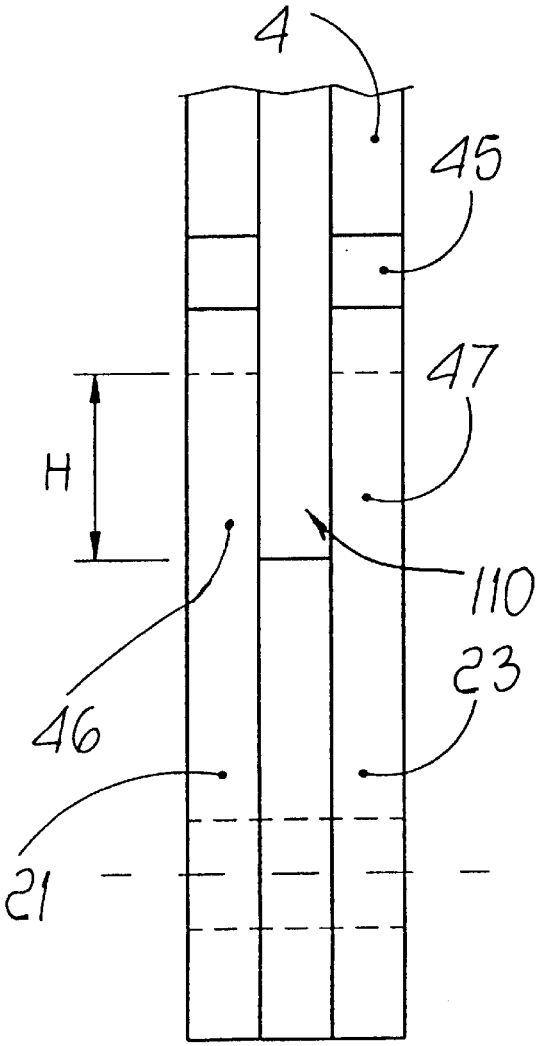

FIGS. 6 and 7 refer to the details of the seat for the cap present on the lever 4 of the moving contacts. The seat 45 for the pins 40 is obtained on two shoulders 46, 47 which create, between them, a vertical groove which makes it possible to house the body of the cap 35. The groove has a sufficient depth (H) to allow the guide staff 30 of the spring to insert itself into the cap 35, in the event that the three hinges 7, 40, 10 of the mechanism 8 are aligned.

Advantageously the shoulders 46, 47 are obtained by means of prolongations provided on the two end fingers 21, 23 which are constituents of the lever 4 of the contacts.

As may be observed from FIG. 2, the lever 4 of the contacts, thrust by the spring 6, bears on a pin 50. Should the moving contacts 4 be closed onto the fixed contacts 105, schematically illustrated, the lever of the moving contacts 4 would not be in contact with the pin 50 but would exhibit a position set further back with respect to the position represented. In this way, the load of the spring would be discharged, through the arcing tips 5, onto the fixed contacts 105.

Figure 3:
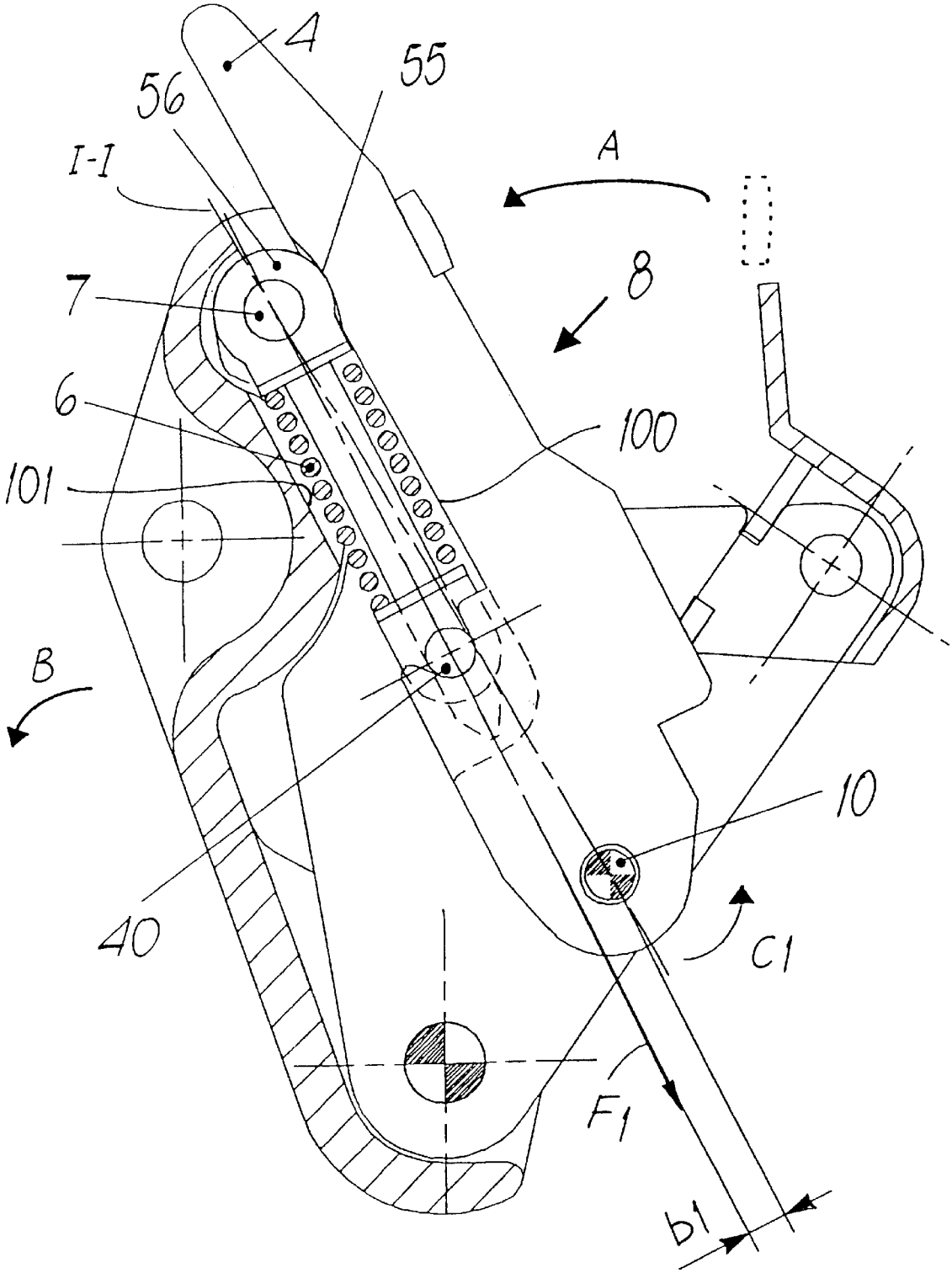
FIG. 3 illustrates, in partially sectioned side view, the crank for supporting the moving contacts in the closed position with the moving contacts retracted.

From FIG. 3 is it possible to observe a different position of the levers of the moving contacts 4. The levers of the moving contacts 4 are in the fully retracted position.

It is possible to define an axis (I—I) joining the centres of the pins 7, 10 for connection of the spring 6 and of the lever of the moving contacts 4 to the crank 1. This axis (I—I) divides into two the plane in which the mechanism 8 works, made up by the spring 6 and by the lever 4 of the moving contacts.

In the illustrated position of the mechanism 8, the hinge made up by the pin 40 of the cap 35 and of the seat 45 of the lever, lies in the opposite half-plane to that shown in FIG. 2.

The contact-carrying levers 4 have, on the side thereof facing the springs 6, depressions forming housing seats 100 for the bodies of the springs.

The operation of the switch according to the invention will be explained through FIGS. 2 and 3.

The levers 4 of the moving contacts can rotate, as indicated by the arrow (A) about a pin 10 connected to the shoulders 3 of the crank 1, under the action of the springs 6 and the electrodynamic actions produced by the flow of the current in the fixed and moving contacts.

The control of the switch, not illustrated, via the link rod 15 connected by a pin 20 to the crank 1, can open the switch by rotating the crank 1 in the direction of the arrow (B) about a pin 25 connected to the shoulders of the box of the switch, these not being illustrated either.

A rotation of the contact-carrying lever 4 compels the cap 35 to rotate in the seat 45 and to slide along the guide staff 30 of the spring 6, reducing the length of the spring 6. The part of staff 30 which protrudes from the cap 35 is inserted into the groove created by the shoulders 46, 47 of the contact-carrying lever 4.

In the working position (in which the moving contacts are shut or closed onto the fixed contacts), the force (F) exerted by the spring 6 on each movable contact element 4 is applied with an arm (b) with respect to the pin 10 for connecting the lever 4 to the crank 1. The consequent torque (C=F'b) applied to the lever of the movable contacts 4, guarantees a pressure on the arcing tips 5 which is necessary to ensure minimum electrical resistance at the point of bearing with the fixed contact. Electrical resistance adapted to the flow of the rated current of the switch.

In the event of a short-circuit, the electrodynamic action of repulsion brought about by the current flowing in the lever of the moving contacts 4 and of the fixed contacts overcomes the torque (C), rotating the lever of the contacts 4 about the pin 10 for linkage with the crank 1 and retracting the lever from the fixed contacts. The rotation of the lever continues until it strikes the surface 55 via the annular head 56 of the guide staff of the spring 6, the precise subcentre position. Indeed, in this position the torque (C1) produced by the force (F1) of the spring 6 times its arm (b1) (distance between the force and the pin 10) has its direction of application reversed with respect to the torque C illustrated in FIG. 2.

By virtue of the torque (C1), the lever of the moving contacts 4 is held in the retracted position illustrated in FIG. 3, guaranteeing the necessary distance between the two arcing tips 5 of the fixed and moving contacts.

In this way the arc generated by the opening of the contacts 4 is successfully extinguished without having to wait for the operating time of the protection relay system and for the operating time of the control mechanism of the switch.

The subsequent operating of the protection relay, causing the control mechanism of the switch to open, and hence the crank 1 to rotate (B), makes provision, by means of a known projection (not illustrated), for carrying the levers of the moving contacts 4 back into the extended position shown in FIG. 2.

What is claimed is:

1. A current switch with moving contacts cooperating with fixed contacts comprising a crank, pivoting about a pin, and a link rod, operationally connected to the crank and to a mechanism for opening and closing the switch, wherein contact-carrying levers are fulcrumed in a lower part thereof to a pin integral with the crank; wherein, above the pin the levers have, on a side opposite to the contacts, seats against which first ends of the spring means bear; and wherein seconds ends of the spring means bear against seats formed at a top region of the crank on one side of a support of the crank, opposite the fixed contacts.

2. The switch according to claim 1, wherein the springs means are guided by guide staffs which extend from the seats of the support to the seats of the levers.

3. The switch according to claim 2, wherein the staffs have rectangular cross-sections.

4. The switch according to claim 2, wherein the seats of the support are shaped as a ring received by a pin connected to the support of the crank.

5. The switch according to claim 4, wherein the seats of the support have a bearing surface for the spring means.

6. The switch according to claim 4, wherein the contact-carrying levers have circular seats for receiving the seats of the support.

7. The switch according to claim 2, wherein the springs means bear against the contact-carrying levers with caps therebetween having through-openings which receive the guide staffs in a slideable manner, and wherein the caps have lateral pins couplable with the seats of the contact-carrying levers.

8. The switch according to claim 7, wherein the seats for the pins of the caps have grooves.

9. The switch according to claim 8, wherein said grooves have an height which is greater than a maximum insertion length of the staff into the cap.

10. The switch according to claim 8, wherein the grooves are made with shoulders having on a top region the seats for the pins of the caps.

11. The switch according to claim 1, wherein the contact-carrying levers have, on a side facing the spring means, depressions forming housing seats for said spring means.

12. The switch according to claim 1, wherein a stop pin effecting a limitation for a pivoting movement of the contact-carrying levers is present on the crank supporting the contact-carrying levers.

* * * * *